US006583543B1

(12) United States Patent
Itaya et al.

(10) Patent No.: US 6,583,543 B1
(45) Date of Patent: Jun. 24, 2003

(54) FLUORESCENT LAMP WITH IMPROVED PRODUCTIVITY, AND MANUFACTURING METHOD FOR THE FLUORESCENT LAMP

(75) Inventors: Kenji Itaya, Takatsuki (JP); Takeshi Matsumura, Kashiwara (JP)

(73) Assignee: Matsushita Electric Industrial Co., LTD, Osaka-fu (JP)

( * ) Notice: Subject to any disclaimer, the term of this patent is extended or adjusted under 35 U.S.C. 154(b) by 133 days.

(21) Appl. No.: 09/802,658

(22) Filed: Mar. 9, 2001

(30) Foreign Application Priority Data

Mar. 24, 2000 (JP) ..... 2000-084337

(51) Int. Cl.[7] ..... H01J 5/48; H01J 5/50; F21V 7/00

(52) U.S. Cl. ..... 313/318.11; 313/113; 362/296; 362/216

(58) Field of Search ..... 313/113, 317, 313/318.01–318.12; 445/22, 26; 362/247, 296, 216, 260

(56) References Cited

U.S. PATENT DOCUMENTS 6,367,947 B1 * 4/2002 Itaya et al. ..... 362/216

FOREIGN PATENT DOCUMENTS

| | | |
|---|---|---|
| JP | 55-109304 | 8/1980 |
| JP | 62-57367 | 4/1987 |
| JP | 62-264547 | 11/1987 |
| JP | 63-87766 | 6/1988 |
| JP | 63-285840 | 11/1988 |
| JP | 3-102759 | 4/1991 |
| JP | 4-267047 | 9/1991 |
| JP | 9-35687 | 2/1997 |
| JP | 2000-251837 | 9/2000 |
| JP | 2000251837 | 9/2000 |

* cited by examiner

*Primary Examiner*—Nimeshkumar D. Patel
*Assistant Examiner*—German Colón

(57) ABSTRACT

An arc tube is a connected bulb composed of three U-shaped bulbs that are set annularly on a holder and connected by a bridge connector to include a serpentine discharge path. Electrodes are provided at both ends of the connected bulb. A reflector is set in a space enclosed by the three U-shaped bulbs, with a predetermined positional relation with the holder. The reflector has a reflecting part which reflects light emitted from the arc tube, and a fixing part positioned at the end of the reflecting part. The holder has an insertion hole which allows the reflecting part to pass through but not the fixing part. The reflector is mounted to the holder by inserting the reflecting part into the insertion hole from the side of the holder opposite to the arc tube, and passing the reflecting part through the insertion hole to the other side.

21 Claims, 9 Drawing Sheets

FLUORESCENT LAMP WITH IMPROVED PRODUCTIVITY, AND MANUFACTURING METHOD FOR THE FLUORESCENT LAMP

This application is based on an application No. 2000-84337 filed in Japan, the content of which is hereby incorporated by reference.

BACKGROUND OF THE INVENTION

1. Field of the Invention

The present invention relates to a fluorescent lamp and a manufacturing method for the same. More particularly, the invention relates to improvements for enhancing the productivity of a fluorescent lamp which is equipped with a reflector to uniformize light distribution, and techniques for maintaining uniform light distribution of such a fluorescent lamp for a long time.

2. Background Art

In general, when a discharge path of a fluorescent lamp is made serpentine, a long discharge path can be formed in a small space, which enables the fluorescent lamp to be miniaturized and to be made as compact as possible.

As one example of such a fluorescent lamp, a bulb-type fluorescent lamp is well known. This fluorescent lamp has multiples of U-shaped bulbs or straight bulbs that are set annularly on a holder. The neighboring bulbs are connected by bridge connection to form such an arc tube that provides a single serpentine discharge path inside the bulbs. The fluorescent lamp is so provided with the arc tube having the serpentine discharge path, the holder for holding the arc tube, and a base provided at the end of the holder.

Such a fluorescent lamp with a serpentine discharge path has a disadvantage that the horizontal light distribution of the lamp is likely to be nonuniform. As an example of technique for improving the horizontal light distribution, a bulb-type fluorescent lamp in which a rodlike reflector is provided in a space enclosed by multiples of U-shaped bulbs is proposed (such a bulb-type fluorescent lamp is hereinafter simply called "fluorescent lamp").

This conventional fluorescent lamp is explained below, with reference to FIGS. 1 and 2.

FIG. 1 illustrates a construction and manufacturing method of the fluorescent lamp. This fluorescent lamp has an arc tube 901 and a holder 902. A rodlike reflector 905 shown in FIG. 2 is placed on the holder 902, to improve the light distribution of the lamp.

The arc tube 901 is composed of three U-shaped bulbs 901*a* and a bridge connector 901*b* which connects neighboring U-shaped bulbs 901*a*. The arc tube 901 is fixed to the holder 902 so as to form a discharge path annularly.

To fix the reflector 905 to the holder 902, a stopper 905*a* is provided to the end of the reflector 905, and a stopper holding part 902*a* is provided to the holder 902. The stopper 905*a* has a notch with two legs.

A slit 905*b* formed between the two legs of the stopper 905*a* provides elasticity. This elasticity is exploited to insert the reflector 905 into the stopper holding part 902*a* from the side of the arc tube 901 (hereafter "arc tube side"), and engage the stopper 905*a* with the stopper holding part 902*a*. Hence the reflector 905 is fixed to the holder 902.

However, this type of fluorescent lamp has the following problems. First, some products still suffer from gradual deterioration of light distribution. Second, the productivity of this type of fluorescent lamp is not particularly good. More specifically, when setting the holder 902 to the arc tube 901, usually a silicon adhesive or the like is used to fix them together. Here, to keep the appearance of the lamp from being ruined by the excess adhesive which squeezes out of the contact area between the holder 902 and the arc tube 901, it is preferable to point upward the end of the arc tube 901 with electrode lead wires, and place the holder 902 onto the arc tube 901 from above. Meanwhile, when setting the reflector 905 to the holder 902, it is preferable to insert the reflector 905 in the direction designated by the arrow shown in FIG. 1, with the arc tube 901 and the holder 902 turned upside down. Thus, the arc tube 901 and the holder 902 have to be turned upside down during the manufacturing operation. This decreases the productivity of the fluorescent lamp.

SUMMARY OF THE INVENTION

In view of the above problems, the first object of the invention is to provide a fluorescent lamp with improved productivity and a manufacturing method for such a fluorescent lamp. The second object of the invention is to provide a fluorescent lamp which can maintain uniform light distribution for a long time.

The first object can be fulfilled by a fluorescent lamp including: an arc tube in which a serpentine discharge path is formed; a holder to which the arc tube is fixed at a predetermined position; and a light reflecting member which is fixed to the holder so as to have a predetermined positional relation with the arc tube, and reflects light emitted from the arc tube, wherein the light reflecting member has a reflecting part which reflects the light from the arc tube, and a fixing part which is fixed to the holder, the holder has a mounting part which includes an area that allows the reflecting part to pass through but does not allow the fixing part to pass through, and the light reflecting member is fixed to the holder by fixing the fixing part to the mounting part in a state where the reflecting part has been passed through the area.

This fluorescent lamp can be manufactured by a manufacturing method including: a holder fixing step for fixing a holder to an arc tube in which a serpentine discharge path is formed, the holder having an area that allows a reflecting part of a light reflecting member to pass through; and a light reflecting member setting step for setting the light reflecting member to the holder, by passing the reflecting part through the area from a side of the holder which is opposite to the arc tube, wherein the light reflecting member has a fixing part which cannot pass through the area, in addition to the reflecting part which can pass through the area, and the fixing part is fixed to the holder in a state where the reflecting part has been passed through the area.

With the above fluorescent lamp and manufacturing method, the process of turning the arc tube upside down becomes unnecessary, and the productivity is improved.

Also, the second object can be fulfilled by the fluorescent lamp of the above construction. The reason for this is given below.

After thorough study of the cause of degradation in light distribution of the conventional fluorescent lamp described above, the inventors of the present application found that part of the stopper 905*a* where the notch with two legs is present tends to become gradually deformed by heat generated during the illumination of the lamp. This deformation occurs in such a direction that makes the width of the slit 905*b* between the two legs smaller, and therefore brings about change in the engagement of the stopper 905*a* with the stopper holding part 902*a*. As a result, the position of the reflector 905 becomes unstable, which cause degradation in light distribution. According to the present invention, on the other hand, the diameter of the fixing part is likely to be larger than the diameter of the reflecting part. Accordingly, it is easy to prevent the occurrence of heat deformation between the reflector and the holder by taking measures such as the increase of the heat capacity of the fixing part, the divergence of heat generated during the illumination of the lamp, and the provision of a slit with one end closed, depending on the factors such as the shape of the fixing part. Hence the second object can be fulfilled.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF THE PREFERRED EMBODIMENT(S)

The following is a description of an embodiment of the present invention with reference to the drawings.

Embodiment

Figure 1:
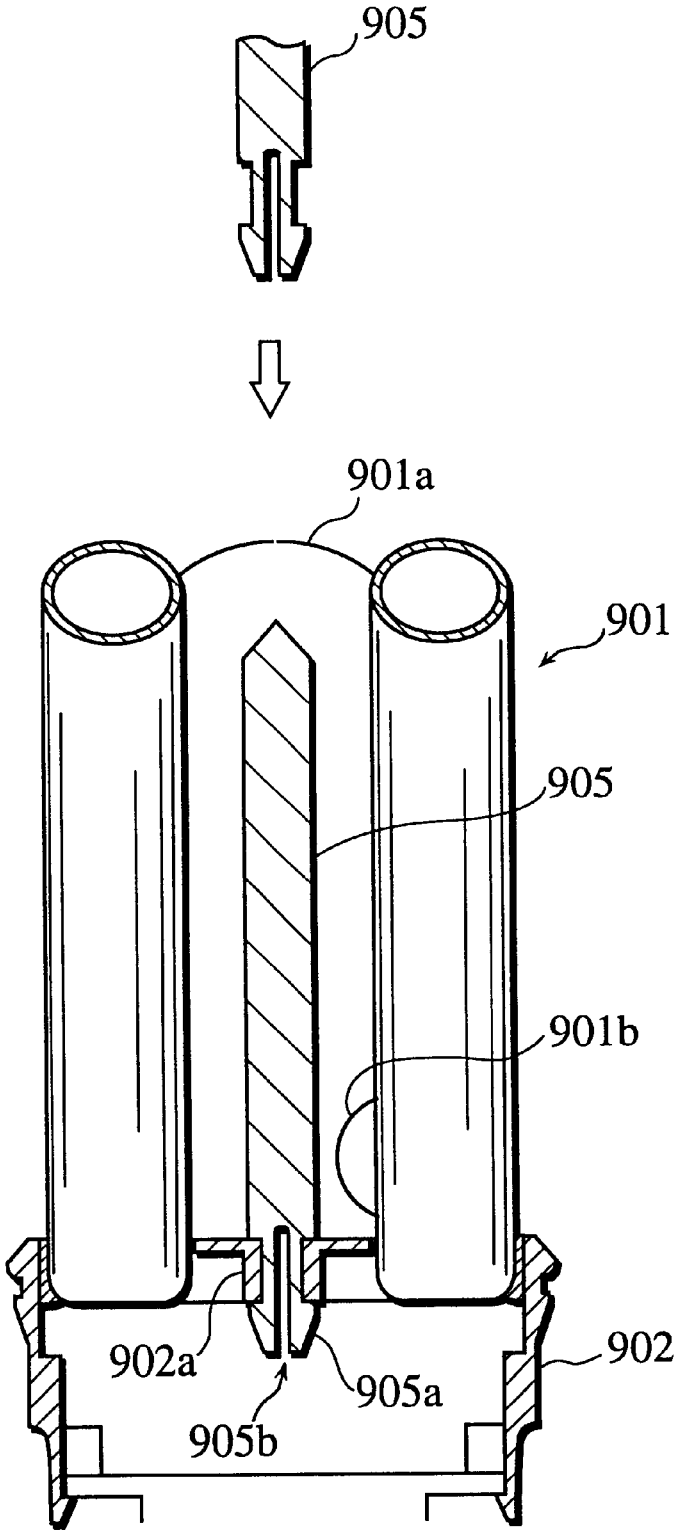
FIG. 1 is a partial perspective and broken view of a construction of a conventional fluorescent lamp.
Figure 2:
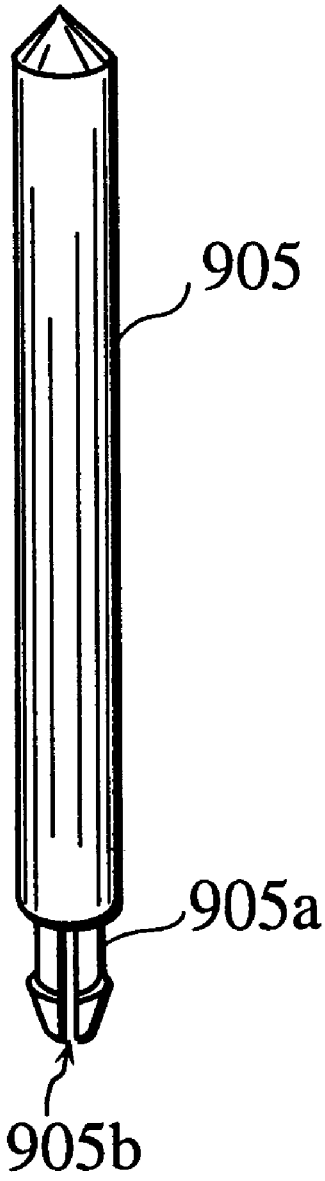
FIG. 2 is a perspective view of an example of a reflector provided in the fluorescent lamp shown in FIG. 1.
Figure 3:
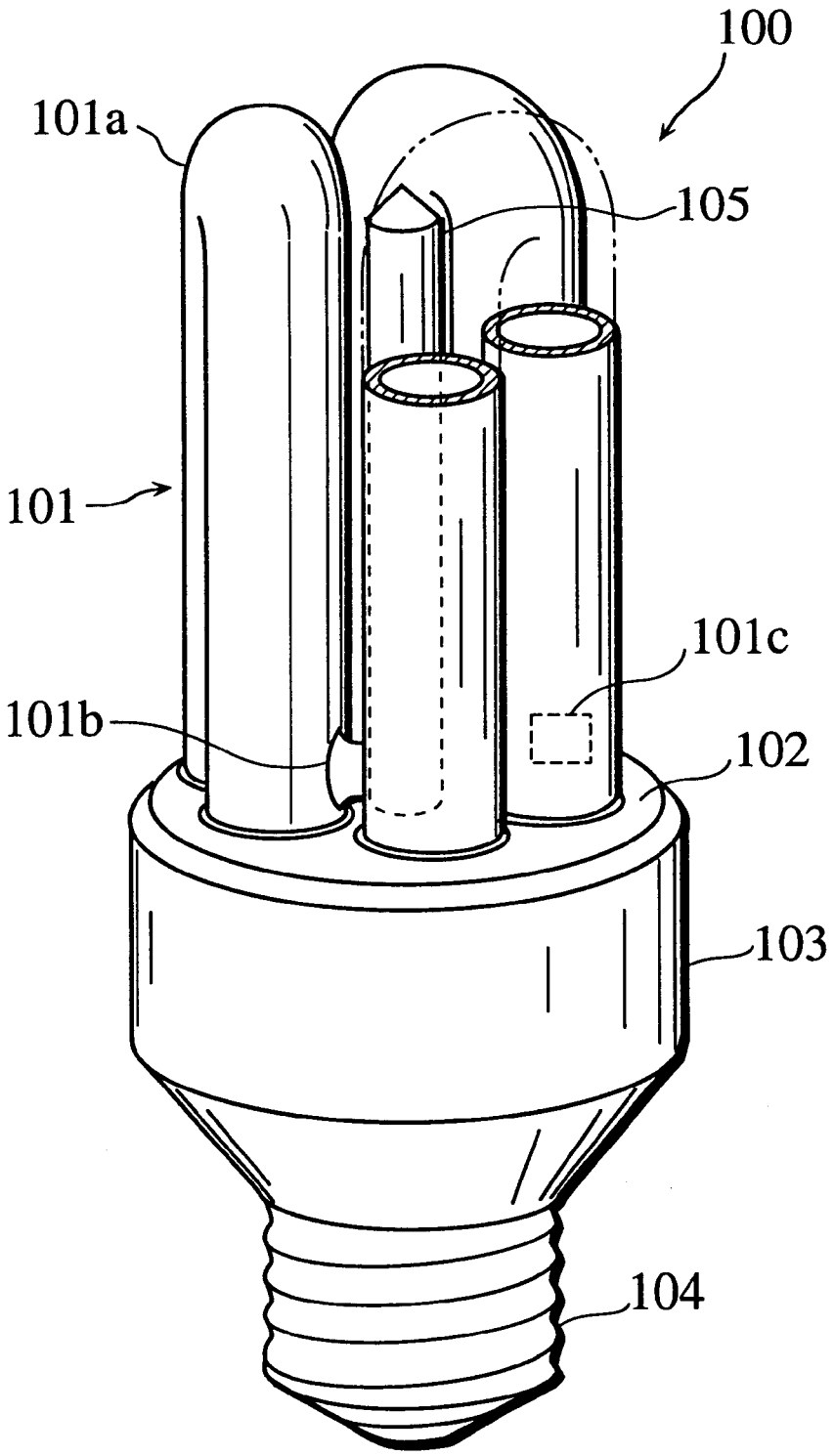
FIG. 3 is a partial perspective and broken view of a construction of a fluorescent lamp that is an embodiment of the invention.

FIG. 3 is a partial perspective and broken view of a construction of a fluorescent lamp to which the embodiment of the invention relates. This fluorescent lamp 100 is equipped with an arc tube 101 having a serpentine discharge path, a holder 102 for holding the arc tube 101, a resin case 103, and a metal base 104 provided at the end of the resin case 103. The resin case 103 can house a lighting circuit (not illustrated) for illuminating the arc tube 101, inside a space formed between the resin case 103 and the holder 102.

The arc tube 101 is composed of three U-shaped bulbs 101*a* and a bridge connector 101*b* which connects neighboring U-shaped bulbs 101*a* to form one connected bulb. The three U-shaped bulbs 101*a* are set annularly on the holder 102. The inner surfaces of the U-shaped bulbs 101*a* are coated with a phosphor, and electrodes 101*c* and 101*d* (101*d* is not shown in FIG. 3) are respectively provided at both ends of the connected bulb. As a result, the serpentine discharge path is formed between the electrodes 101*c* and 101*d* inside the arc tube 101.

In this embodiment, a reflector 105 that is made of a white resin and supported by the holder 102 at one end is provided in a space enclosed by the holder 102 and the three U-shaped bulbs 101*a*. This reflector 105 serves to improve the light distribution of the fluorescent lamp 100. A detailed explanation on the reflector 105 of the embodiment is given below.

Figure 4A:
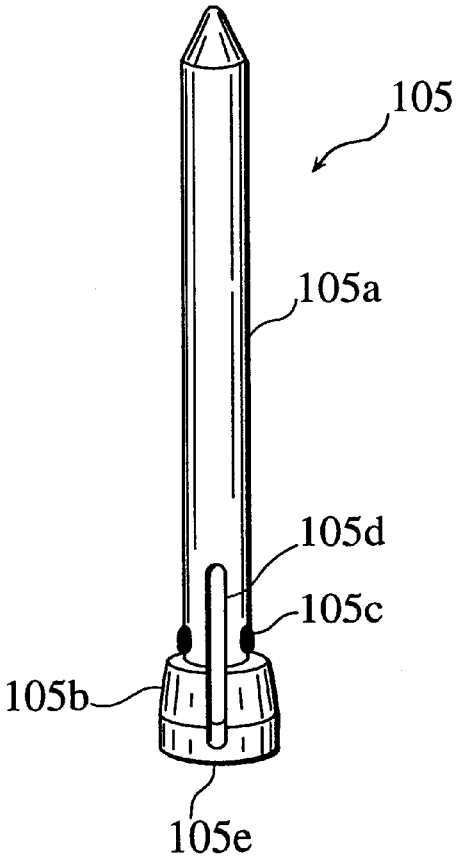
FIGS. 4A and 4B show an example of a reflector provided in the fluorescent lamp shown in FIG. 3.
Figure 4B:
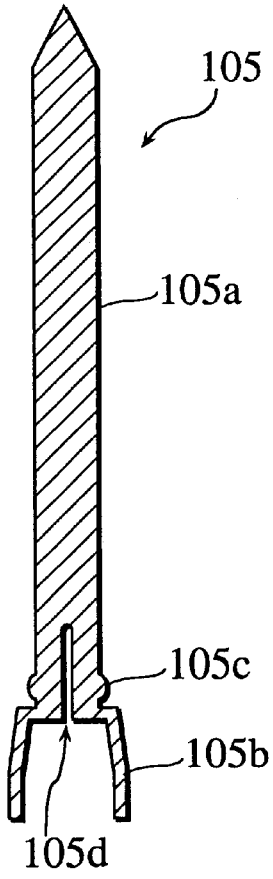

FIG. 4 shows an example shape of the reflector 105. FIG. 4A is a perspective view of the reflector 105, whereas FIG. 4B is a sectional view of the reflector 105. The reflector 105 has a rodlike reflecting part 105*a* and a fixing part 105*b* positioned at the end of the reflecting part 105*a*. The tip of the reflecting part 105*a* has a conical shape, and the remaining part has a cylindrical shape. In this embodiment, the reflecting part 105*a* and the fixing part 105*b* are formed in one piece of a white resin. Also, a stopper 105*c* and a slit 105*d* which has a closed part 105*a* at one end are provided in and near the boundary between the reflecting part 105*a* and the fixing part 105*b*. Since the inside of the fixing part 105*b* is hollow as shown in FIG. 4B, the slit 105*d* serves to provide elasticity in such a direction that makes the diameter of the reflector 105 smaller, in the vicinity of the fixing part 105*b* and the stopper 105*c*.

Figure 5A:
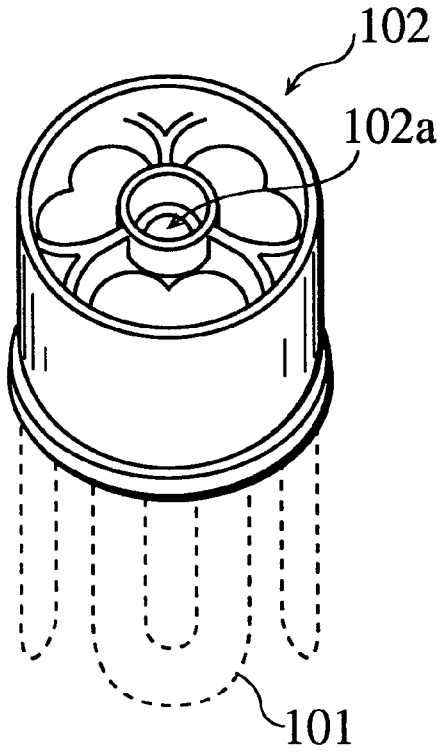
FIGS. 5A and 5B show an example of a holder provided in the fluorescent lamp shown in FIG. 3.
Figure 5B:
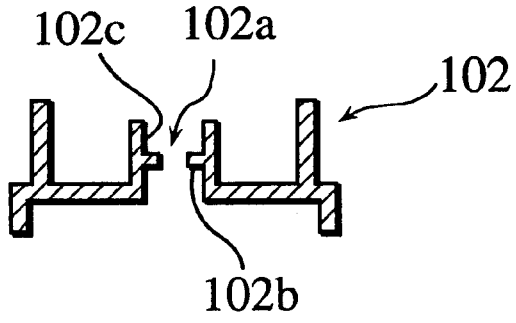

FIG. 5 shows an example shape of the holder 102. FIG. 5A is a perspective view of the holder 102 from the side of the resin case 103 (hereafter "case side"), after the fluorescent lamp 100 is assembled. The arc tube 101 is fixed at the position indicated by the dotted lines in the drawing. FIG. 5B is a sectional view of the holder 102.

Figure 6:
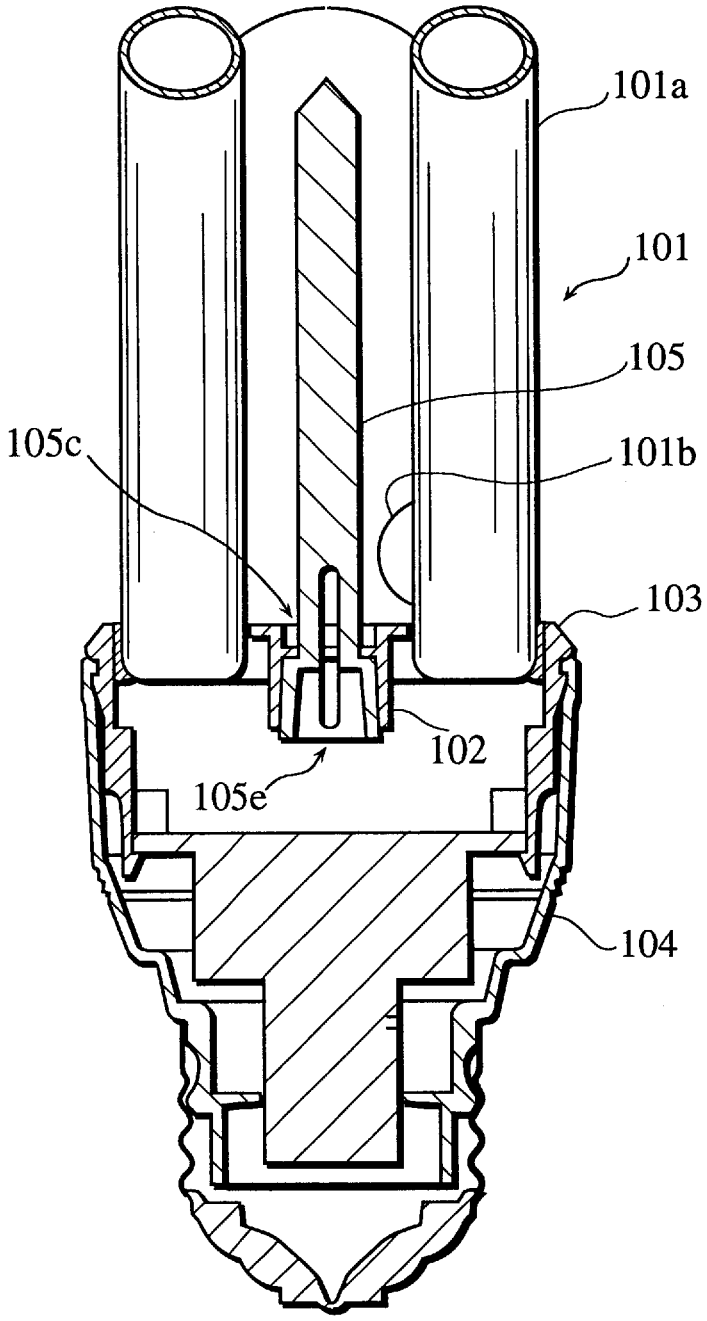
FIG. 6 is a partial sectional view of the fluorescent lamp shown in FIG. 3, which is given for explaining a structure of fixing the reflector to the holder.

As shown in FIGS. 5A and 5B, the holder 102 includes an insertion hole 102*a* that allows the reflecting part 105*a* to pass through but does not allow the fixing part 105*b* to pass through. The holder 102 is such constructed that an edge part 102*b* of the insertion hole 102*a* is caught between the stopper 105*c* and the fixing part 105*b* of the reflector 105. In other words, the reflecting part 105*a* is inserted into the insertion hole 102*a* of the holder 102 from the case side, and passed through the insertion hole 102*a* to the arc tube side. Then, the fixing part 105*b* is pressure-welded to a tubular part 102*c* of the holder 102 in a state where the outer surface of the fixing part 105*b* is in contact with the inner surface of the tubular part 102*c,* and the stopper 105*c* is engaged with the edge part 102*b,* as shown in FIG. 6. Thus, the reflector 105 is fixed to the holder 102 with greater stability.

Figure 7A:
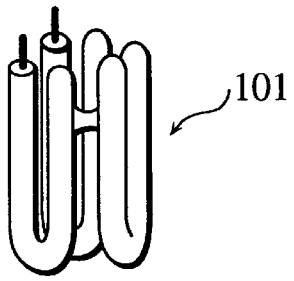
FIGS. 7A–7C show a manufacturing method of the fluorescent lamp in FIG. 3.
Figure 7B:
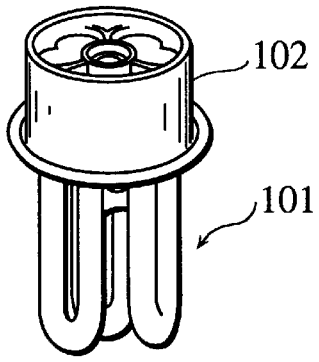
Figure 7C:
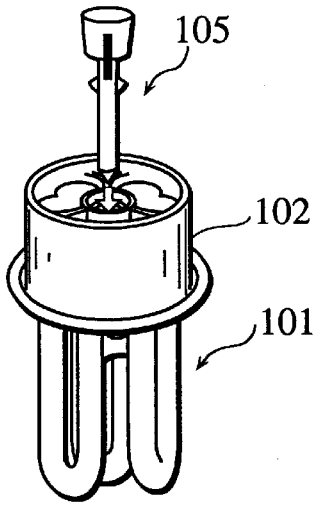

The following is an explanation of a manufacturing method of the fluorescent lamp 100. FIGS. 7A to 7C show the manufacturing method. In FIG. 7A, the arc tube 101 is carried on a belt conveyer or the like, with the lead wires of the electrodes 101*c* and 101*d* pointing upward. The arc tube 101 is held in place on the belt conveyer by clamps (not illustrated) or the like. In FIG. 7B, the holder 102 is placed onto the arc tube 101 from above, and the holder 102 and the arc tube 101 are fixed together using a silicon adhesive or the like.

In FIG. 7C, the reflector 105 is inserted from above into the insertion hole 102*a* of the holder 102. After the reflector 105 is fixed to the holder 102, the lighting circuit (not illustrated), the resin case 103, and the base 104 are placed onto the holder 102 from above. This completes the manufacture of the fluorescent lamp 100.

According to the above manufacturing method, the mounting of the holder 102 to the arc tube 101 and the mounting of the reflector 105 to the holder 102 are made in the same direction. When compared with the conventional method of mounting the reflector from the tube arc side, the manufacturing operation can be simplified. Which is to say, conventionally it is assumed to be preferable to connect the electrodes and the lighting circuit with at least the lead wires of the electrodes pointing upward, while it is also assumed to be preferable to mount the reflector to the holder from the arc tube side with the lead wires of the electrodes pointing downward. Based on these assumptions, conventionally the arc tube is turned upside down between the setting of the lighting circuit and the setting of the reflector, which causes decreases in productivity. However, according to the manufacturing method of this embodiment, there is no need to turn the arc tube 101 upside down. In other words, the holder 102, the reflector 105, the lighting circuit, and so on can be mounted one by one, without changing the orientation of the arc tube 101 with the electrode lead wires facing upward. As a result, the productivity can be improved.

Modifications

Though the present invention has been explained based on the above embodiment, the invention should not be limited to such. For example, the following modifications are applicable.

(1) The above embodiment describes the case where the reflector 105 is fixed to the holder 102 by pressure-welding the fixing part 105*b* to the inner surface of the tubular part 102*c,* and engaging the stopper 105*c* with the edge part 102*b.* However, the method of fixing the reflector 105 to the holder 102 is not limited to such. For example, instead of the pressure-welding, the fixing part 105*b* may be adhered to the holder 102 using an adhesive. Also, the stopper 105*c* can be omitted.

Figure 8:
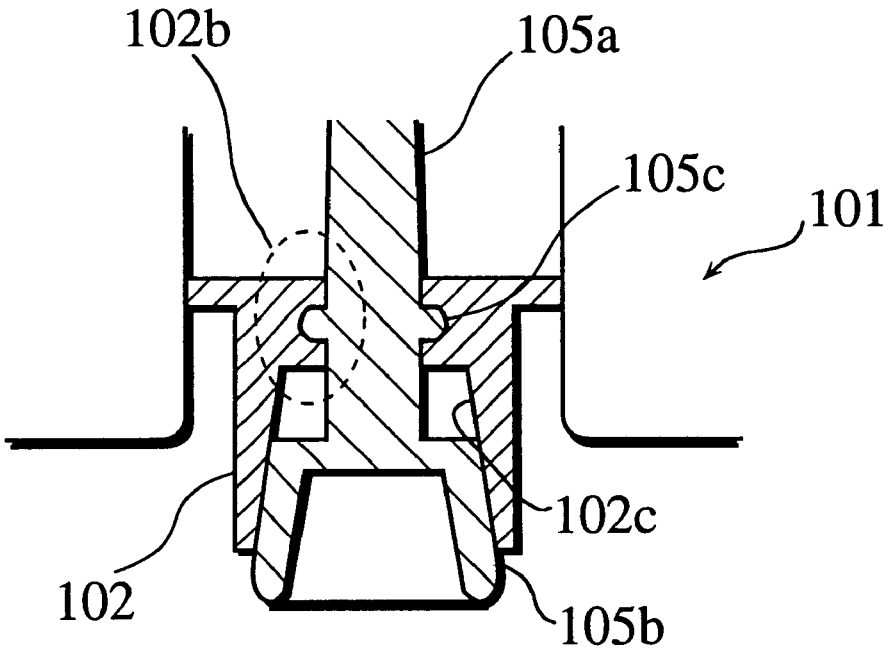
FIG. 8 is a sectional view showing a modification of the invention.

(2) The above embodiment describes the case where the entire outer surface of the fixing part 105*b* and the entire inner surface of the tubular part 102*c* are made into contact with each other, as shown in FIG. 6. Such entire surface contact has the effect of diffusing heat generated during the illumination of the fluorescent lamp 100, but the invention is not limited to such. For instance, the embodiment may be modified such that part of the fixing part 105*b* is in contact with the tubular part 102*c,* with the stopper 105*c* being engaged with the edge part 102*b,* as shown in FIG. 8.

(3) The above embodiment describes the case where the fixing part 105*b* has a tapered shape which gradually narrows in diameter toward the reflecting part 105*a.* This shape is believed to be preferable when pressure-welding the fixing part 105*b* to the tubular part 102*c,* but the fixing part 105*b* may be of a different shape such as a pyramid or a cylinder. Especially in the case where the fixing part 105*b* is adhered to the holder 102 using an adhesive, the fixing part 105*b* may take any shape such as a plate, a cube, or a rectangular prism, as long as part of the fixing part 105*b* cannot pass through the insertion hole 102*a.* In this case, there is no need to provide elasticity to the fixing part 105*b,* so that the slit 105*d* can be omitted. Also, the inside of the fixing part 105*b* may be not hollow but solid.

Figure 9:
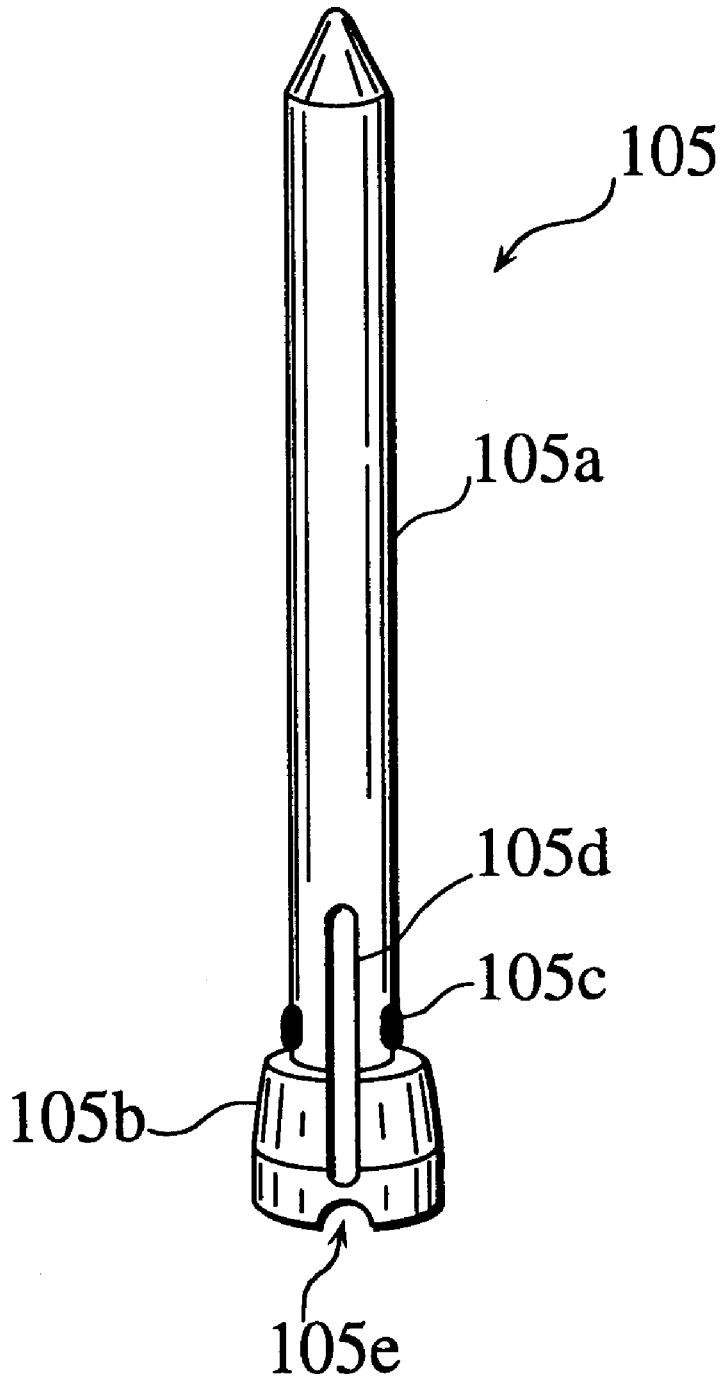
FIG. 9 is a perspective view showing a reflector according to another modification of the invention.

(4) The above embodiment describes the case where the slit 105*d* having the closed part 105e is included in the reflector 105 to provide elasticity in the vicinity of the fixing part 105*b* and the stopper 105*c,* so as to ease the setting of the reflector 105 to the holder 102. Here, it is preferable for the slit 105*d* to have the closed part 105*e,* in order to reliably keep the fixing part 105*b* from becoming deformed by heat. However, depending on the factors such as the size of the fixing part 105*b,* the end of the slit 105*d* may be not closed but opened. Also, the slit 105*d* does not have to be long and narrow. The slit 105*d* can be of various shapes such as nearly a circle, depending on elasticity which should be provided. Further, the closed part 105*e* need not be positioned at the end of the fixing part 105*b.* For instance, the closed part 105e may be positioned as shown in FIG. 9.

(5) The above embodiment describes the case where the reflector 105 is formed by forming the reflecting part 105*a* and the fixing part 105*b* in one piece of a white resin. However, the reflecting part 105*a* and the fixing part 105*b* may be formed separately, and later integrated to form the reflector 105. When forming the reflecting part 105*a* and the fixing part 105*b* separately, they may be formed from the same material or different materials.

Specifically, instead of the white resin the reflecting part 105*a* may be formed from a material such as a resin, a glass, and a metal, as long as it has reflection effects. The reflecting part 105*a* may also be formed using a reflective coating. Likewise, the fixing part 105*b* can be selected from a variety of materials. The same applies to the case where the reflecting part 105*a* and the fixing part 105*b* are formed in one piece. Also, when using the white resin, a resin such as polyethylene terephthalate (PET) or polybutylene terephthalate (PBT) is desirable in terms of elasticity provided to the fixing part 105*b.* Moreover, a thermal degradation protective coating or an ultraviolet ray degradation protective coating may be applied to the surface of the reflector 105 and the like.

(6) The above embodiment describes the case where the fluorescent lamp 100 has the three U-shaped bulbs 101*a* which are connected via the bridge connector 101*b* to form the arc tube 101 and are positioned annularly on the holder 102. However, the invention can be applied to other types of fluorescent lamps, as long as they are constructed such that an arc tube having a serpentine discharge path is fixed to a holder. Therefore, the number of U-shaped bulbs 101*a* is not limited to three. For example, the invention may be applied to a fluorescent lamp with four U-shaped bulbs (positioned in the shape of square). Also, the size of each clearance between neighboring bulbs 101*a* is not particularly limited. In addition, the shape of the bulb 101*a* is not limited to the U-shape. For instance, the arc tube 101 may have a plurality of straight bulbs whose ends are bridge-connected to form a serpentine discharge path. Furthermore, the number of bulbs 101*a* is not limited to plural. The invention is applicable to a fluorescent lamp with a single bulb forming a serpentine discharge path.

(7) The above embodiment describes the case where the reflecting part 105*a* is made up of the conical part in its tip and the cylindrical part, but the shape of the reflecting part 105*a* is not limited to such. The reflecting part 105*a* may be made up of a pyramidal part such as a hexagonal pyramid, and a prismatic part such as a hexagonal prism. The diameter of the cylindrical part or the width of the prismatic part need not be constant along its length. For example, the cylindrical part or the prismatic part may taper off to a point. It should be noted, however, that the height of the cylindrical part or prismatic part is preferably smaller than the height of the Ushaped bulbs 101*a,* to improve the light distribution of the upper part of the fluorescent lamp 100 in which the arc tube 101 having the plurality of bridge-connected U-shaped bulbs 101*a* is positioned annularly.

(8) The above embodiment describes the case where the reflector 105 shaped like a pillar is set approximately at the center of the fluorescent lamp 100 with the plurality of Ushaped bulbs 101*a* arranged annularly. However, the reflector 105 is not limited to the pillar shape, and may be of a different shape depending on the factors such as the shape and placement conditions of the arc tube 101. For example, a member such as a reflective board may be positioned between pairs of legs of the U-shaped bulbs 101*a.* This means the shape of the insertion hole 102*a* provided in the holder 102 need not be circular. The insertion hole 102*a* can take any shape depending on the shape of the reflector 105 and particularly of the reflecting part 105*a.* Also, the insertion hole 102*a* need not be a through-hole. The insertion hole 102*a* may have a notch, as long as it does not allow the fixing part 105*b* to pass through.

(9) The above embodiment describes the case where the invention is applied to the bulb-type fluorescent lamp that has the holder 102 mounted to the resin case 103 with the metal base 104. However, the invention is not limited to this type of fluorescent lamp. For example, the holder 102 may be directly attached to a wall or ceiling.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fluorescent lamp comprising:

an arc tube in which a serpentine discharge path is formed;

a holder to which the arc tube is fixed at a predetermined position; and a light reflecting member which is fixed to the holder so as to have a predetermined positional relation with the arc tube, and reflects light emitted from the arc tube, wherein the light reflecting member has a reflecting part which reflects the light from the arc tube, and a fixing part which is fixed to the holder, the holder has a mounting part which includes an area that allows the reflecting part to pass through but does not allow the fixing part to pass through, and the light reflecting member is fixed to the holder by fixing the fixing part to the mounting part in a state where the reflecting part has been passed through the area.

2. The fluorescent lamp of claim 1, wherein the reflecting part is set at a substantial center of the holder, and the arc tube is set along outer edges of the holder so as to surround the reflecting part.

3. The fluorescent lamp of claim 2, wherein the area is an insertion hole that allows the reflecting part to pass through but does not allow the fixing part to pass through, and the mounting part includes a tubular part which is at least partially in contact with the fixing part in a state where the fixing part is fixed to the mounting part.

4. The fluorescent lamp of claim 3, wherein the fixing part and the tubular part have surfaces which are at least partially in contact with each other in the state where the fixing part is fixed to the mounting part.

5. The fluorescent lamp of claim 4, wherein the fixing part is shaped like a tube, and has elasticity in such a direction that makes the fixing part smaller in cross section.

6. The fluorescent lamp of claim 5, wherein the fixing part has a slit which provides the elasticity.

7. The fluorescent lamp of claim 6, wherein the slit is closed at one end opposite to the reflecting part.

8. The fluorescent lamp of claim 6, wherein the fixing part is pressure-welded to the tubular part.

9. The fluorescent lamp of claim 4, wherein the reflecting part has a pillar part.

10. The fluorescent lamp of claim 9, wherein the pillar part is shaped like a cylinder, and the fixing part has a cylindrical part whose diameter is larger than the pillar part.

11. The fluorescent lamp of claim 10, wherein the cylindrical part is shaped so as to taper toward the reflecting part.

12. The fluorescent lamp of claim 3, wherein the light reflecting member has a stopper which engages with a part of the holder forming the insertion hole.

13. The fluorescent lamp of claim 12, wherein a part of the light reflecting member where the stopper is present has elasticity in such a direction that makes the light reflecting member smaller in cross section.

14. The fluorescent lamp of claim 2, wherein the discharge path is formed by connecting a plurality of bulbs.

15. The fluorescent lamp of claim 2, wherein the light reflecting member is formed in one piece of a white resin.

16. The fluorescent lamp of claim 1, wherein the fixing part is fixed to the mounting part, by engaging a stopper provided in the fixing part, with a stopper holding part provided in the mounting part.

17. The fluorescent lamp of claim 16, wherein the stopper has elasticity.

18. A manufacturing method of a fluorescent lamp, comprising:

a holder fixing step for fixing a holder to an arc tube in which a serpentine discharge path is formed, the holder having an area that allows a reflecting part of a light reflecting member to pass through; and a light reflecting member setting step for setting the light reflecting member to the holder, by passing the reflecting part through the area from a side of the holder which is opposite to the arc tube, wherein the light reflecting member has a fixing part which cannot pass through the area, in addition to the reflecting part which can pass through the area, and the fixing part is fixed to the holder in a state where the reflecting part has been passed through the area.

19. The manufacturing method of claim 18, wherein the holder fixing step fixes the holder to the arc tube from above, with two electrodes equipped at both ends of the arc tube facing upward, and the light reflecting member setting step passes the reflecting part through the area from above.

20. The manufacturing method of claim 19, wherein the holder fixing step fixes the holder to the arc tube using an adhesive.

21. The manufacturing method of claim 19, wherein the light reflecting member setting step fixes the fixing part to a tubular part provided in the holder, by pressure welding.

* * * * *